US006277008B1

(12) United States Patent
Masuta et al.

(10) Patent No.: US 6,277,008 B1
(45) Date of Patent: Aug. 21, 2001

(54) POLISHING APPARATUS

(75) Inventors: Youko Masuta; Mitsuyoshi Uto, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/291,585

(22) Filed: Apr. 12, 1999

(30) Foreign Application Priority Data

Apr. 10, 1998 (JP) ..... 10-099231

(51) Int. Cl.[7] ..... B24B 7/22

(52) U.S. Cl. ..... 451/286; 451/285; 451/288; 451/397

(58) Field of Search ..... 451/41, 285–289

(56) References Cited

U.S. PATENT DOCUMENTS

| | | | | |
|---|---|---|---|---|
| 5,645,474 | * | 7/1997 | Kubo et al. | 451/287 |
| 5,795,215 | * | 8/1998 | Guthrie et al. | 451/286 |
| 5,997,384 | * | 12/1999 | Blalock | 451/41 |
| 6,019,670 | * | 2/2000 | Cheng et al. | 451/56 |

FOREIGN PATENT DOCUMENTS

| | | |
|---|---|---|
| 1352932 | 5/1974 | (GB) . |
| 7-227757 | 8/1995 | (JP) . |
| 9-139366 | 5/1997 | (JP) . |
| 9-155730 | 6/1997 | (JP) . |
| 10-0267597 | 7/2000 | (JP) . |

* cited by examiner

*Primary Examiner*—Joseph J. Hail, III
*Assistant Examiner*—G Nguyen
(74) *Attorney, Agent, or Firm*—Hutchins, Wheeler & Dittmar

(57) ABSTRACT

A polishing apparatus includes a polishing pad, a substrate holder, and a retainer ring. The polishing pad is adhered to a polishing table. The substrate holder urges, while it holds a substrate as a polishing target, a polishing target surface of the substrate against the polishing pad. The retainer ring is formed on a holding surface of the substrate holder to correspond to the circumference of the substrate. The retainer ring has a resin portion formed on its surface which is to come into contact with the polishing pad, and an annular resin holding portion for holding the resin portion and made of a material having a higher mechanical strength than the resin portion.

2 Claims, 4 Drawing Sheets

POLISHING APPARATUS

BACKGROUND OF THE INVENTION

The present invention relates to a polishing apparatus used in, e.g., chemical-mechanical polishing (CMP).

A technique for planarizing a substrate surface by polishing has been employed in many fields including the semiconductor substrate fabrication process. In recent years, CMP for planarizing the unevenness of a surface, e.g., the unevenness of the surface of an interlevel insulating film, formed during the fabrication by polishing is used in a process of fabricating devices on a semiconductor substrate.

In CMP, hard polishing cloth made of a material such as foamed polyurethane, different from relatively soft polishing cloth comprised of unwoven fabric used for polishing the surface of the semiconductor substrate, is used to planarize the insulating film. To obtain the polishing uniformity within the substrate surface, an elastic cushion layer is generally formed under a hard pad.

FIGS. 4A and 4B show the arrangement of a conventional polishing apparatus.

As shown in FIG. 4A, the conventional polishing apparatus is constituted by a substrate holder 409 for holding a polishing target, a polishing table 410 to which a polishing pad 402 is adhered, an abrasive supply member 411, and a conditioning mechanism 413 on which a diamond pellet 412 is mounted. Mechanisms provided to the substrate holder 409 and conditioning mechanism 413 to rotate, swing, and press them, and a rotational mechanism provided to the polishing table 410 are not illustrated.

As shown in FIG. 4B, a retainer ring 401 is set on a surface of the substrate holder 409 which opposes a substrate 405, to correspond to the circumference of the substrate 405. The retainer ring 401 holds the substrate 405 and prevents lateral shift of the substrate 405. As the material of the retainer ring 401, a hard plastic such as polyethylene terephthalate is used. An air cushion 407 applies a downward load to the retainer ring 401. An elastic layer called an insert pad 403 is formed on the surface of the substrate holder 409 inside the retainer ring 401.

By using the polishing arrangement having the above arrangement, for example, the surface of an interlevel insulating layer in the multilevel interconnection structure of an LSI is planarized.

During polishing, the retainer ring 401 prevents not only lateral shift of the substrate 405 but also abnormal polishing of the outer peripheral portion of the substrate 405. More specifically, during polishing, the substrate 405 is urged against the polishing table 410 by the polishing pad 402 consisting of an upper hard layer and a lower soft layer. The contact pressure is the maximum at the outer peripheral portion of the substrate 405.

At this time, as shown in FIG. 5A, the polishing pad 402 is deformed by the pressing force of the substrate 405 for several mm from the outer peripheral portion of the substrate 405, and the pressure acting on the outer peripheral portion of the substrate 405 decreases. As a result, the polishing amount on the outer peripheral portion of the substrate 405 decreases. In particular, depending on the modulus of elasticity of the insert pad 403 and other polishing conditions, a deformation region 501 of the polishing pad 402 sometimes extends for several cm from the outer peripheral portion of the substrate 405.

In the conventional polishing apparatus, abnormal polishing is suppressed in the following manner. First, the surfaces of the retainer ring 401 and substrate 405 that are to come into contact with the polishing pad 402 are set to be flush. The width of the retainer ring 401 with which the retainer ring 401 is to come into contact with the polishing pad 402 is set to be equal to or more than the deformation region described above of the polishing pad 402. This suppresses a deformation region 502 from extending over the outer peripheral portion of the substrate 405, as shown in FIG. 5B.

A load is applied to the retainer ring 401 by the air cushion 407 independently of applying a load to the substrate 405. This makes the pressure that presses the retainer ring 401 against the polishing pad 402 independent and constant. For example, the retainer ring 401 is brought into contact with the polishing pad 402 with a load of about 500 g/cm$^2$ (≈7 psi).

For this reason, during polishing, the retainer ring 401 is also polished by the polishing pad 402, and the material of the retainer ring 401 generated by grinding spreads over the polishing pad 402 as impurities. In this case, if an alloy material such as stainless steel is used to form the retainer ring 401, the metal component generated by grinding spreads over the polishing pad 402 to adversely affect the characteristics of devices formed on the substrate 405. Also, the cutting chips of the alloy material damage the polishing surface of the polishing pad 402. To solve these problems, a plastic is used as the material of the conventional retainer ring 401.

As the process amount increases, the plastic retainer ring 401 deforms, and the specified performance is not maintained.

In this case, even if a hard plastic is used to suppress deformation, its mechanical strength is limited and inferior to that of a metal alloy material such as stainless steel. Even a conventional retainer ring using a hard plastic deforms when the number of polishing processes increases, and the capability of the retainer to press the polishing pad degrades. As a result, in the conventional polishing apparatus, when the number of polishing processes increases, an abnormality in polishing amount occurs on the outer peripheral portion of the substrate as a polishing target.

SUMMARY OF THE INVENTION

It is an object of the present invention to provide a polishing apparatus in which, even if the number of polishing processes increases, occurrence of an abnormality in polishing amount on the outer peripheral portion of the substrate as a polishing target is suppressed.

In order to achieve the above object, according to the present invention, there is provided a polishing apparatus comprising a polishing pad adhered to a polishing table, a substrate holder for urging, while holding a substrate as a polishing target, a polishing target surface of the substrate against the polishing pad, and a retainer ring formed on a holding surface of the substrate holder to correspond to a circumference of the substrate, the retainer ring having a resin portion formed on a surface thereof which is to come into contact with the polishing pad, and an annular resin holding portion for holding the resin portion and made of a material having a higher mechanical strength than the resin portion.

DESCRIPTION OF THE PREFERRED EMBODIMENT

The present invention will be described in detail with reference to the accompanying drawings.

Figure 1A:
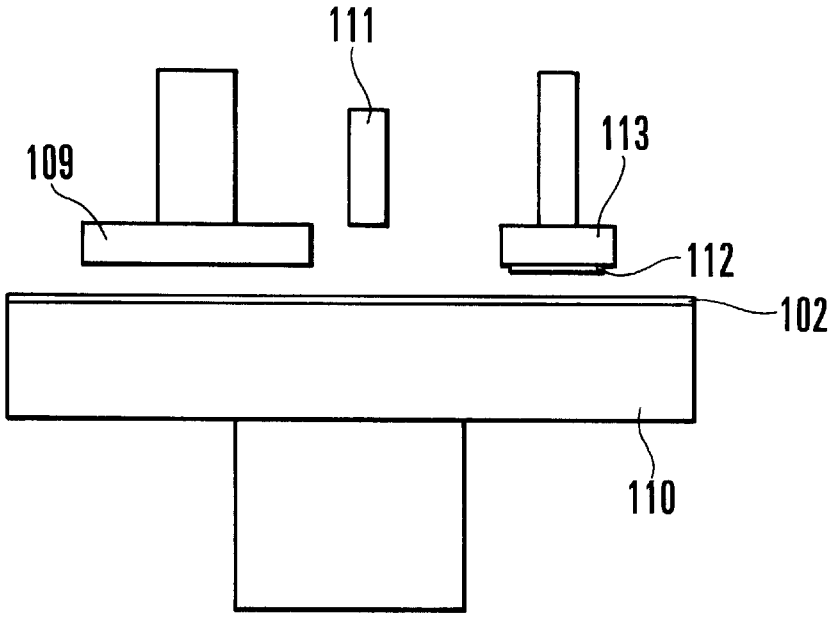
FIG. 1A is a front view of a polishing apparatus according to an embodiment of the present invention.

FIG. 1 schematically shows a polishing apparatus according to an embodiment of the present invention. As shown in FIG. 1A, the polishing apparatus according to this embodiment is constituted by a substrate holder 109 for holding a substrate as a polishing target, a polishing table 110 to which a polishing pad 102 is adhered, an abrasive supply member 111, and a conditioning mechanism 113 on which a diamond pellet 112 is mounted.

The polishing pad 102 has a two-layered structure constituted by an upper hard layer and a lower soft layer. Mechanisms provided to the substrate holder 109 and conditioning mechanism 113 to rotate, swing, and press them, and a rotational mechanism provided to the polishing table 110 are not illustrated.

Figure 1B:
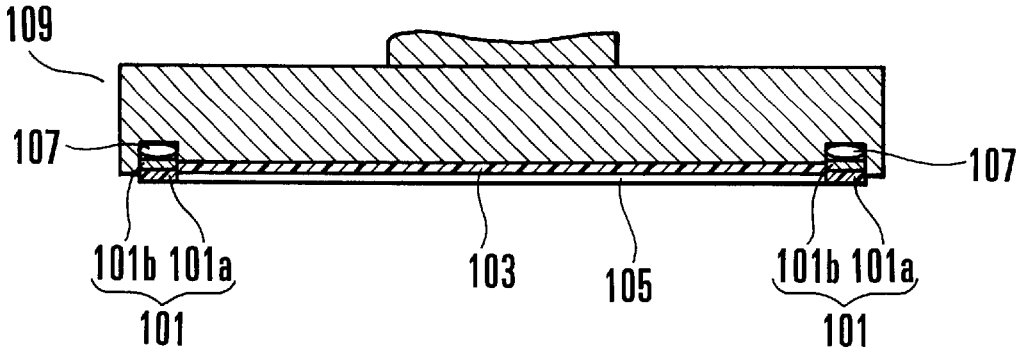
FIG. 1B is a sectional view of the main part of the substrate holder shown in FIG. 1A.

As shown in FIG. 1B, a retainer ring 101 is set on a surface (holding surface) of the substrate holder 109 which opposes a substrate 105, to correspond to the circumference of the substrate 105. The retainer ring 101 holds the substrate 105 and prevents lateral shift of the substrate 105. An air cushion 107 biases the retainer ring 101 toward the polishing table 110. An elastic layer called an insert pad 103 is formed on the surface of the substrate holder 109 inside the retainer ring 101.

To perform polishing, the polishing target surface of the substrate 105 is pressed against the polishing pad 102 through the insert pad 103. For example, part of the multilevel interconnection structure of an LSI is formed on the polishing target surface of the substrate 105, and an interlevel insulating film is formed on the uppermost layer of the multilevel interconnection structure. An unevenness formed by a lower wiring layer or the like is present on the surface of the interlevel insulating film. The polishing apparatus of this embodiment planarizes this unevenness by cutting and polishing in accordance with CMP.

As shown in FIG. 1B, the retainer ring 101 is constituted by a lower resin portion 101*a* made of a hard plastic such as polyethylene terephthalate, and an upper metal portion 101*b* made of, e.g., SUS 316 (stainless steel). The metal portion 101*b* serving as a resin holding portion, and the resin portion 101*a* are firmly bonded to each other with an adhesive. A surface of the resin portion 101*a* of the retainer ring 101 which is to come into contact with the polishing pad 102 is set to be flush with that of the polishing target surface of the substrate 105.

The retainer ring 101 is biased by using the air cushion 107 independently of controlling a load to the substrate 105. This makes the pressure that presses the retainer ring 101 against the polishing pad 102 independent and constant. For example, the retainer ring 101 is brought into contact with the polishing pad 102 with a biasing force (pressure) of about 500 g/cm$^2$ (≈7 psi).

According to this embodiment, the retainer ring 101 has a two-layered structure constituted by the resin portion 101*a* and metal portion 101*b*. As a result, compared to a conventional case wherein the whole retainer ring is formed of a hard plastic, the mechanical strength of the retainer ring 101 increases considerably.

Of the retainer ring 101, only its resin portion 101*a* comes into contact with the polishing pad 102, and its metal portion 101*b* does not. Therefore, no metal component will spread over the polishing pad 102 to adversely affect the characteristics of devices formed on the substrate 105. Also, the polishing surface of the polishing table will not be damaged by the cutting chips of the metal material.

A practical example of polishing apparatus of this embodiment will be described.

Figure 2:
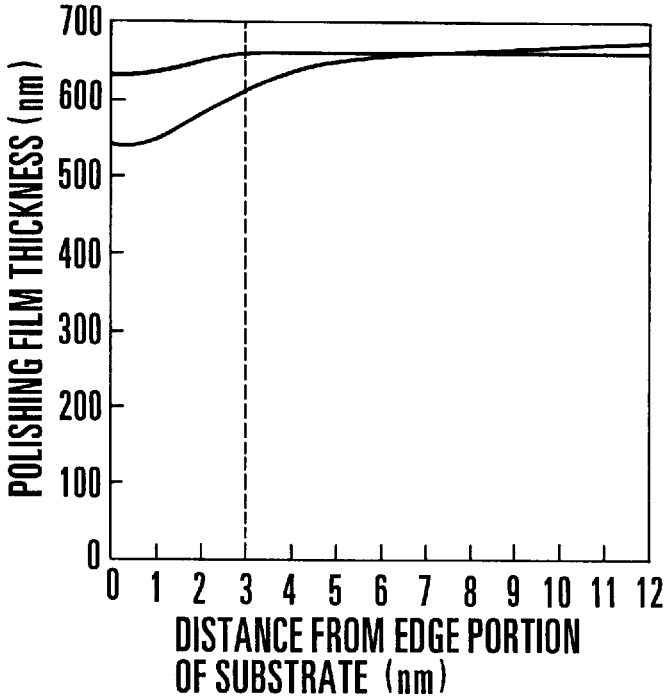
FIG. 2 is a graph showing the polishing characteristics.

In the polishing apparatus using the retainer ring 101, an 8-inch diameter silicon substrate formed with an oxide film on its surface was employed as a sample. The oxide film was removed by CMP. The thickness of the oxide film to be removed by polishing was set to about 650 nm. Under these conditions, 25 substrates were polished. When the 26th substrate was polished, a region where the polishing film thickness was smaller by about 20 nm to 30 nm was formed at a region of about 3 mm from the outer peripheral portion of the silicon substrate, as indicated by a curve (a) of FIG. 2.

Figure 4A:
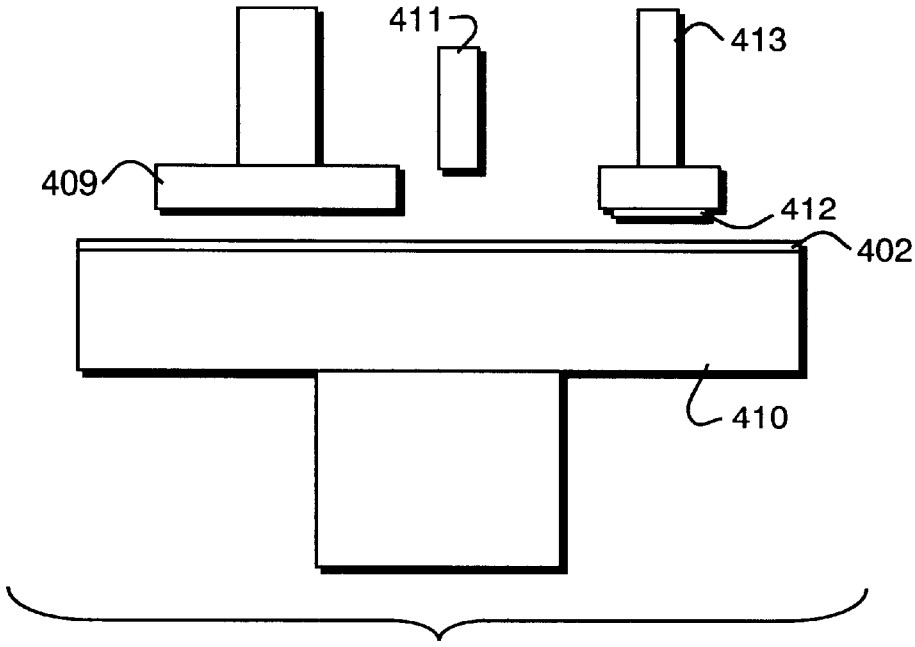
FIG. 4A (PRIOR ART)
FIG. 4A is a front view of a conventional polishing apparatus.
Figure 4B:
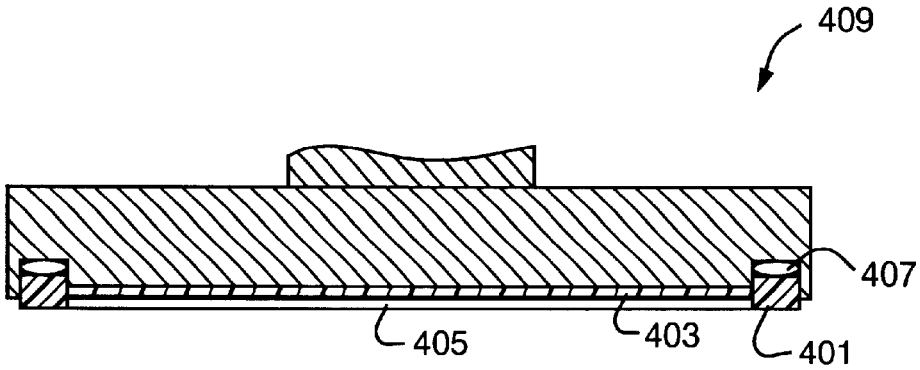
FIG. 4B (PRIOR ART)
FIG. 4B is a sectional view of the main part of the substrate holder shown in FIG. 4A.
Figure 5A:
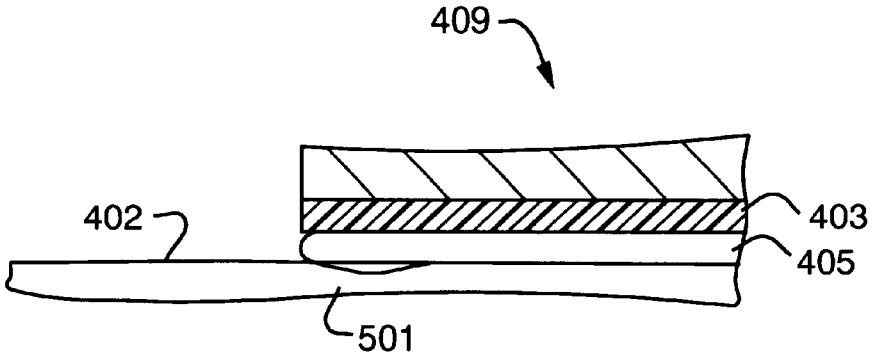
FIG. 5A (PRIOR ART)
FIGS. 5A and 5B are views each showing deformation of the polishing pad.
Figure 5B:
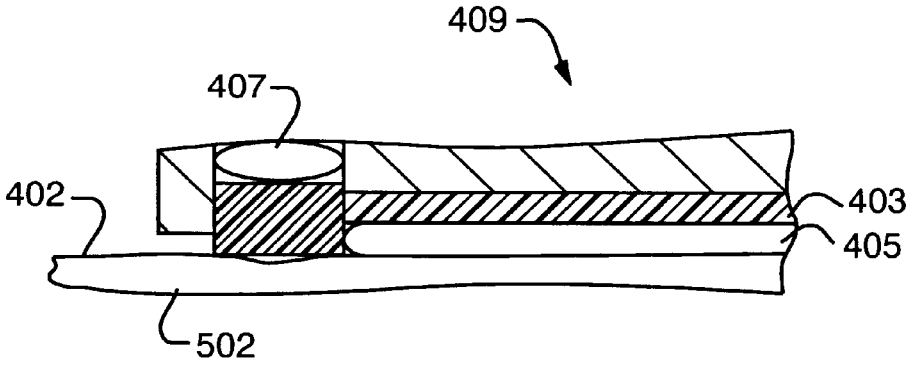
FIG. 5B (PRIOR ART)

In contrast to this, the same process was performed by using the conventional retainer ring 401 (FIG. 4B) formed of only a hard plastic. As a result, a region where the polishing film thickness was small was formed at a region of about 5 mm or more from the outer peripheral portion of the silicon substrate, as indicated by a curve (b) of FIG. 2.

In this manner, when the retainer ring 101 of this embodiment is used, even if the polishing process amount increases, abnormal polishing occurring on the outer peripheral portion of the substrate as the polishing target can be suppressed.

Figure 3A:
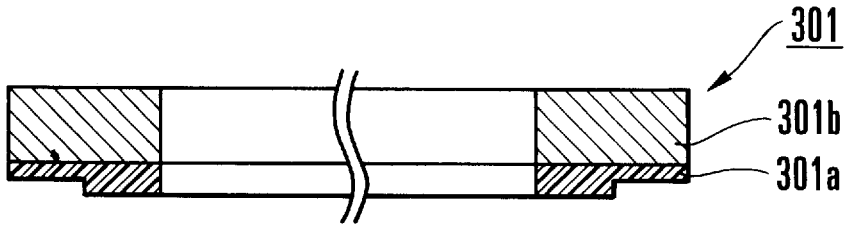
FIGS. 3A and 3B are views each showing deformation of the retainer ring shown in FIG. 1B.

In the embodiment, the resin portion 101*a* and metal portion 101*b* of the retainer ring 101 have almost the same shape. However, the present invention is not limited to this. For example, as shown in FIG. 3A, a stepped resin portion 301*a* may be formed, and the shapes of the resin portion 301*a* and a metal portion 301*b* may be different from each other. When a retainer ring 301 is formed in this manner, its mechanical strength and its contact area with the polishing pad 102 of the polishing table 110 can be designed freely.

Figure 3B:
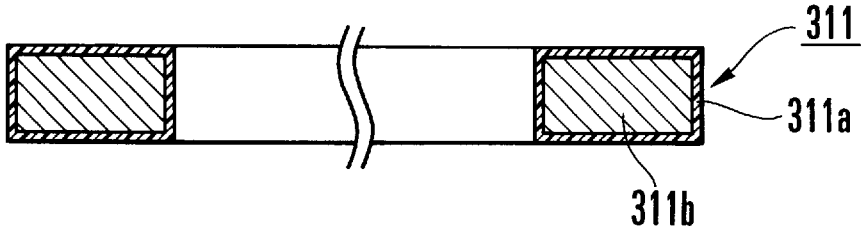

As shown in FIG. 3B, a retainer ring 311 may be formed such that its resin portion 311*a* covers its annular metal portion 311*b*. When the retainer ring 311 is formed in this manner, the resin portion 311*a* and metal portion 311*b* need not be brought into tight contact with each other through an adhesive or the like. As a result, even when the resin portion 311*a* cannot be adhered to the metal portion 311*b* depending on combinations of the materials, the retainer ring 311 can be fabricated.

In the above embodiment, stainless steel is used to form the metal portion, and polyethylene terephthalate is used to form the resin portion. However, the present invention is not limited to this, but the following engineering plastics may be used instead. More specifically, examples are polycarbonate, polyamide, polybutylene terephthalate, polysulfone, polyether sulfone, polyether ether ketone, polyamide imide, polyether imide, a chlorotrifluoroethylene-ethylene copolymer, and the like.

The material of the metal portion is not limited to stainless steel, but a metal having a resistance to corrosion and a high mechanical strength, or its alloy may be used.

As has been described above, according to the present invention, since a resin is used to form only a surface of the retainer ring which is to come into contact with the polishing pad, a higher mechanical strength than that obtained when the entire retainer ring is made of only a resin can be obtained. As a result, even when the number of polishing processes increases, the retainer ring does not substantially deform, and occurrence of an abnormality in polishing amount on the outer peripheral portion of the substrate as the polishing target can be suppressed.

What is claimed is:

1. A polishing apparatus comprising:

a polishing pad adhered to a polishing table;

a substrate holder for holding a substrate as a polishing target, while urging a polishing target surface of the substrate against said polishing pad; and a retainer ring formed on a holding surface of said substrate holder to correspond to a circumference of the substrate, said retainer ring having a resin portion formed on a surface thereof which is to come into contact with said polishing pad, and an annular holding portion for holding said resin portion and made of a material having a higher mechanical strength than said resin, wherein said retainer ring resin holding portion is encapsulated with said resin portion.

2. A polishing apparatus comprising:

a polishing pad adhered to a polishing table;

a substrate holder for holding a substrate as a polishing target, while urging a polishing target surface of the substrate against said polishing pad; and a retainer ring formed on a holding surface of said substrate holder to correspond to a circumference of the substrate, said retainer ring having a stepped resin portion formed on a surface thereof, a smaller diameter upper portion of said stepped resin portion disposed to come into contact with said polishing pad, and an annular holding portion for holding said resin portion and made of steel.

* * * * *